US005130052A

United States Patent [19]

Kreh et al.

[11] Patent Number: 5,130,052

[45] Date of Patent: Jul. 14, 1992

[54] CORROSION INHIBITION WITH WATER-SOLUBLE RARE EARTH CHELATES

[75] Inventors: Robert P. Kreh, Jessup, Md.; Vincent R. Kuhn, Twin Lakes, Wis.; John Richardson, Palatine, Ill.; Robert M. Spotnitz, Baltimore, Md.; Charles G. Carter, Silver Spring, Md.; Vladimir Jovancicevic, Columbia, Md.

[73] Assignee: W. R. Grace & Co.-Conn., New York, N.Y.

[21] Appl. No.: 782,361

[22] Filed: Oct. 24, 1991

[51] Int. Cl.[5] ..... C23F 11/12

[52] U.S. Cl. ..... 252/387; 422/19; 210/698; 210/699; 210/700; 210/701

[58] Field of Search ..... 422/19; 252/387; 210/698, 699, 700, 701

[56] References Cited

U.S. PATENT DOCUMENTS

| | | | |
|---|---|---|---|
| 3,617,576 | 1/1971 | Kerst | 252/700 X |
| 3,718,603 | 2/1973 | Mitchell | 252/389.22 |
| 4,105,581 | 8/1978 | Gaupp et al. | 252/389.2 |
| 4,495,225 | 1/1985 | Ciuba et al. | 427/236 |
| 4,501,667 | 2/1984 | Cook | 210/700 |
| 4,606,890 | 2/1984 | Fisk | 422/15 |
| 4,675,215 | 6/1987 | Ciuba et al. | 427/372.2 |
| 4,749,412 | 6/1988 | Ciuba et al. | 106/14.23 |
| 4,749,550 | 6/1988 | Goldie et al. | 422/19 |

FOREIGN PATENT DOCUMENTS 2097024 4/1982 United Kingdom .

OTHER PUBLICATIONS

Huheey, James, E. *Inorganic Chemistry*, 3rd edition, Harper & Row, Publishers: New York, 1983, pp. 806–814.

*Primary Examiner*—Deborah L. Kyle
*Assistant Examiner*—Valerie Fee
*Attorney, Agent, or Firm*—James P. Barr

[57] ABSTRACT

A method of inhibiting corrosion of a metal surface in an aqueous system having a pH of at least 6, comprising maintaining in the aqueous system, in an amount effective to inhibit corrosion, a water-soluble, organic-rare earth metal chelate which is derived from a rare earth metal having an atomic number from 57 to 71 and an organic chelant. The organic chelant provides not only water solubility but surprisingly enhanced corrosion inhibiting activity. The water-soluble, organic-rare earth chelates may be advantageously combined with other corrosion inhibitors such as zinc chelates, organophosphonates, phosphates, chromates, molybdates, and the like.

42 Claims, 1 Drawing Sheet

CORROSION INHIBITION WITH WATER-SOLUBLE RARE EARTH CHELATES

FIELD OF THE INVENTION

The present invention is related to a method of inhibiting corrosion of metals in contact with aqueous systems. More specifically, the present invention is related to a method of inhibiting corrosion wherein a water soluble, organic-rare earth metal chelate is added to an aqueous system in an amount effective to inhibit or prevent corrosion of metals in contact with the aqueous system.

BACKGROUND OF THE INVENTION

In aqueous systems, particularly industrial aqueous systems, corrosion inhibition is necessary for the protection of the metallic parts of the equipment which are exposed to the aqueous solution such as, for example, heat exchangers, pipes, engine jackets, and the like. Corrosion inhibitors are generally added to the aqueous system to prevent metal loss, pitting and tuberculation of such equipment parts.

There are certain disadvantages in using any of the conventional corrosion inhibitors since each present certain drawbacks. For example, chromates are known to be very effective in inhibiting corrosion, but are very toxic. Phosphorus-based corrosion inhibitors such as phosphates and organophosphonates can lead to scale deposition and are also environmentally undesirable. Zinc is not a very effective corrosion inhibitor at low levels (<1 ppm) and is also not very effective at high pH (above 7.5) due to the limited solubility of $Zn(OH)_2$. Molybdates, while known to be effective corrosion inhibitors at high concentrations, are generally not cost-effective. Thus, there exists a need for a non-chromate, non-phosphorus-based, cost-effective corrosion inhibitor for the protection of metal surfaces in contact with aqueous systems.

Rare earth metal cations, which are releasably bound to the surface of a substrate by ion exchange or which are in the form of inorganic salts, have recently been shown to be useful in aqueous systems to inhibit the corrosion of metals. For example, *Metals Forum*, Vol. 7, No. 7, p. 211 (1984) and U.S. Pat. No. 4,749,550 demonstrated corrosion inhibition using rare earth metal cations of yttrium and the lanthanum series when introduced to the aqueous system in the form of water soluble salts. Effective corrosion inhibition was obtained with a cation concentration as low as 0.4 millimoles per liter (equivalent to 56 ppm), while the preferred lower limit was one millimole per liter (equivalent to 140 ppm). *Zh. Prikl. Khim. (Leningrad)*, 47(10), 2333 (1974) discloses corrosion inhibition with praseodymium and neodymium nitrites.

However, the above referenced inorganic rare earth metal salts have very limited solubilities in aqueous systems, and are, in fact, substantially insoluble in aqueous solutions having pH above 6, or which have high alkalinity or moderate to high hardness. It is an essential requirement for any corrosion inhibitor that it be soluble in the aqueous systems in which the metal is to be protected, not only since solubility permits delivery of the inhibitor to the surface sites where corrosion is occurring but also to avoid deposition of solid particles which can lead to the formation of scale deposits. The foregoing prior art inorganic rare earth metal salts have been found to be ineffective corrosion inhibitors under normal operating conditions of industrial aqueous systems which typically have pHs in the range 7 to 9, which have high alkalinity (as carbonate) and/or which have moderate to high hardness (mineral content) since they are practically insoluble under these conditions.

Other water-insoluble rare earth metals, in the form of carboxylate compounds (U.S. Pat. No. 4,495,225) and rare earth metal-thiourea complexes (*Sb. Nauch, Tr. Yaroslav. Gos. Ped. In-t* (192)32, have been used in coatings to provide corrosion inhibition. However, coating of the metal surfaces is not always a viable approach to corrosion inhibition particularly where the surface exposed to the corrosive aqueous media is internal to the system, and thus not readily coatable; where the coating of the system would limit or reduce the flow rate of the circulating water after coating; and/or where the coating would detract from the heat transfer efficiency. The above problems present themselves in almost all industrial aqueous applications such- as the internal surfaces of heat exchangers, boilers, cooling towers, pipes and engine jackets. Thus, there is a need for corrosion inhibitors which will work while dissolved in these aqueous systems which inherently have relatively high pHs, high alkalinity and/or moderate to high hardness. Corrosion inhibitors must be soluble, stable and active under the normal operating conditions of these systems. Moreover, these properties must not be adversely affected by the presence of other water treatment compositions or by other conditions which are generally associated with such aqueous systems. These conditions generally include the presence of oxygen in the aqueous system (which accelerates corrosion), a high degree of hardness associated with excessive amounts of calcium, magnesium and carbonate ions, as well as elevated temperature, pH conditions, and the like.

SUMMARY OF THE INVENTION

It is an object of this invention to provide a method of inhibiting corrosion in aqueous systems having a pH above 6.

It is another object of this invention to provide a method of inhibiting corrosion in aqueous systems having a high degree of alkalinity and/or a moderate to high degree of hardness.

It is another object of this invention to provide a novel, water-soluble, organic-rare earth metal chelate, optionally together with other known corrosion inhibitors, for use as a corrosion inhibitor in aqueous systems.

It is another object of this invention to provide a surprisingly effective corrosion inhibiting composition which contains a combination of a water-soluble, organic-rare earth metal chelate together with one or more water-soluble organic-zinc chelates.

In accordance with the present invention, there has been provided a method and composition for inhibiting corrosion of metals which are in contact with aqueous systems which have a pH greater than 6, wherein a water-soluble, organic-rare earth metal chelates is added to the aqueous systems in an amount effective to inhibit corrosion. The organic-rare earth metal chelates of this invention employ rare earth metals having appropriate organic chelants which provide not only the necessary water solubility but also surprisingly provide enhanced corrosion inhibition activity. Rare earth or lanthanide metals suitable for use in this invention include those elements of atomic number 57 to 71, inclusive.

Also provided in accordance with the present invention are certain novel compositions comprising combinations of water-soluble, organic-rare earth metal chelates together with one or more water-soluble organic-zinc chelates.

Also provided in accordance with the present invention is a method of inhibiting corrosion of a metal which is in contact with an aqueous system which comprises adding to the system at least one water-soluble rare earth metal chelate together with a water-soluble, organic zinc chelate in amounts effective to inhibit corrosion.

BRIEF DESCRIPTION OF THE INVENTION

Figure 1:
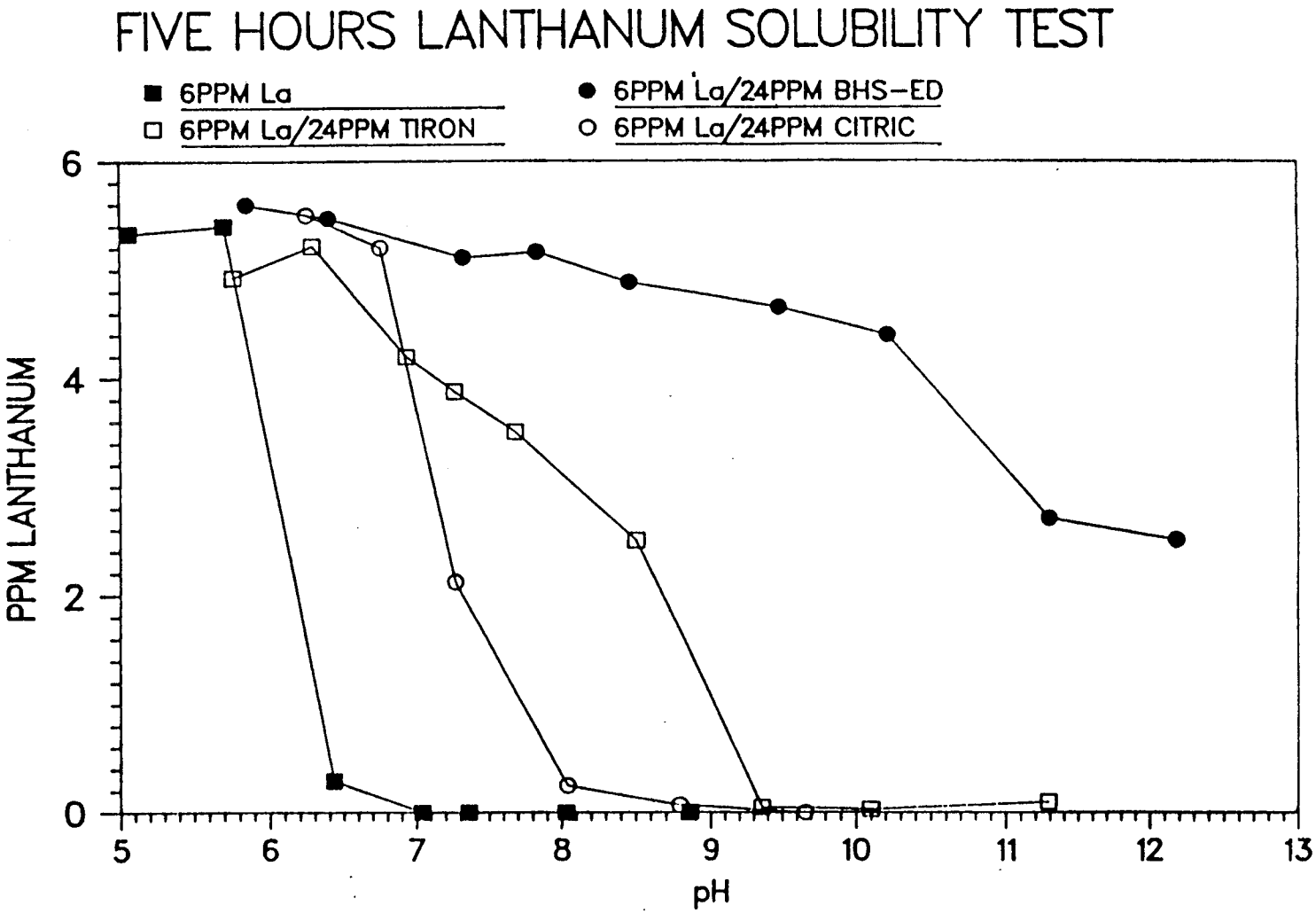
FIG. 1 shows the relative solubilities of rare earth metal salts and water-soluble organic rare earth chelates, as typified by Lanthanum, in aqueous solutions having a pH in the range 5 to 13.

The present invention is directed to certain novel methods and compositions for inhibiting corrosion of metals which are in contact with aqueous systems. It has now been found that water soluble organic-rare earth metal chelates, which are derived from rare earth metals and certain water-soluble, organic chelants, as hereinafter defined, effectively inhibit corrosion of metals which are in contact with aqueous systems having a pH of at least 6, particularly in the presence of alkalinity and/or a moderate to high degree of hardness. The use of the subject water-soluble, organic rare-earth metal chelates, either alone or in combination with known corrosion inhibitors, in aqueous systems having a pH greater than 6, preferably between 7 and 12 and most preferably between 7.5 and 11, has unexpectedly been found to prevent metal loss, pitting and tuberculation of metals which are in contact with water. As used herein, the term "water-soluble" means that the solubility of the organic-rare earth metal chelate exceeds 1 ppm in the aqueous system where corrosion is to be inhibited. For purposes of this invention an organic-rare earth metal chelate is defined as an adduct prepared from a carbon-containing molecule ("chelant") and a rare-earth metal wherein the adduct contains one or more rings of 5 or more atoms generally less than 10 atoms, preferably 5 to 8 atoms and wherein the rings include the rare earth metal and part of the organic chelant molecule. The organic chelant can be a small molecule which is capable of binding a single rare-earth metal cation or, alternatively, it can be a large molecule, including polymers, such that many rare earth metal cations may be bound to a single organic chelant. The carbon-containing molecule can be a $C_1$ to $C_{20}$ alkyl, cycloalkyl, aromatic, or a water soluble polymer having a molecular weight in the range 500 to 1 million, preferably 1000 to 300,000. The organic chelants contained in these adducts have strong affinities for the rare-earth metal ions and result in stable, water-soluble, coordination complexes. For purposes of this invention, rare earth (or lanthanide) metals are defined herein as those elements of atomic number from 57 to 71, inclusive. A preferred rare-earth metal for use in this invention is lanthanum.

The water-soluble, organic-rare earth metal chelates of this invention are derived from the above defined rare earth metals together with certain water-soluble, organic chelants which have good solubility in aqueous systems and which are strong complexing agents with the rare earth metals. The resultant rare earth metal chelants are readily soluble in aqueous systems, and thus provide enhanced corrosion inhibiting activity. In order to provide both solubility and enhanced corrosion inhibition, it has been found that certain chelants, i.e. those containing particular combinations of donor groups, have proven to be particularly effective. It has been discovered that the organic chelant preferably contains the following donor groups: 1) two or more aromatic hydroxy groups, particularly where carboxylic acid or sulfonic acid groups are also attached to the aromatic ring, or 2) four or more donor groups selected from carboxylic acid, amine, amine oxide, sulfonic acid, phosphonic acid and hydroxyl groups, particularly where the four donor groups include two or more carboxylic acid groups or two or more phosphonic acid groups; so as to provide a water soluble rare-earth chelate when combined with a rare earth metal ion at a pH above 6.0.

The rare earth chelates are characterized by the following generalized equilibrium:

$$RE^{n+} + [H_mL]^{(-1)} \underset{K_{(eq)}}{\rightleftharpoons} [RE-L]^{(n-m-1)} + mH^+$$

where RE represents the rare earth ion in its typical oxidation state (n =3 or 4). The organic chelant is represented by $H_mL$, where m indicates the number of protons which are released upon binding of the rare earth cation to the organic chelant at the system pH. The charge of the "free" chelant is indicated by 1. The value of $K_{(eq)}$ for various chelants can be readily determined by those skilled in the art. For example, the value of $K_{(eq)}$ for citric acid at pH $\geqq 7$ is reported to be $10^{7.7}$ (A. E. Martell and R. M. Smith, "Critical Stability Constants", Plenum Press, New York 1974, Vol. 3, page 161). The equilibrium constant, $K_{(eq)}$, should be sufficiently large to maintain a very low concentration of rare earth metal cations ($RE^{n+}$) under the conditions of usage (dependent upon pH and the concentrations of RE and L). It is important to maintain a very low concentration of free rare earth metal cations in the treated system in order to avoid scale formation which would otherwise result from the inherent insolubility of free rare earth metal cations in aqueous systems having pH's above 6 (see FIG. 1). FIG. 1 shows the enhanced solubility of the rare earth metals, in the form of water-soluble organic rare earth metal chelates, in a test water which was prepared to simulate actual aqueous systems found in cooling water systems (see Example 1), to very high pH values by the binding of the rare earth metal cations to an organic chelant. It is important that the bond between the rare earth cation and the chelant be maintained to a very high extent so as to maximize the enhanced corrosion inhibition which has been obtained with the rare earth chelates (RE-L). In general, the concentration of soluble, unchelated $RE^{n+}$ ions should be less than 1% of the RE-L concentration, and accordingly the concentration of soluble free rare-earth metal cations in solution is generally far below 25 ppm, preferably below 2-5 ppm, more preferably below 1 ppm, and most preferably below 0.01 ppm.

When the above preferred chelants of this invention are added to a typical aqueous system, it has been determined that the concentration of free rare earth metal cation is below 1 ppm. This is due, not only to the insolubility of free rare earth metal cations under the normal operating conditions of industrial aqueous systems, i.e. pH above 6 and moderate to high hardness, but also to the strong affinity of the rare-earth metal cation for the organic chelants. In fact, it has been determined that when the rare earth metal cations and water-soluble organic chelants of this invention are added in equimolar amounts to an aqueous solution having a pH greater than 6, the concentration of free rare-earth metal cations in solution is generally far below 1 ppm for even the weakest organic chelants which are capable of generating water-soluble rare earth chelates. For example, a combination of citric acid at 30 ppm and $La^{3+}$ at 7 ppm demonstrated very good corrosion inhibition at pH 8.5 (example 4). Using the above values for pH, $K_{(eq)}$ and the concentrations of $La^{3+}$ and citric acid, the calculated values are 16 ppm of rare earth chelate (RE-L) and 0.0014 ppm of free rare earth cation ($RE^{n+}$).

The organic-rare earth metal chelates of this invention may be prepared by dissolving rare earth metal cations, usually in the form of water-soluble salts, in an aqueous solution containing a suitable water soluble organic chelant in at least an equi-molar amount to the rare-earth metal cation, preferably in a greater than equi-molar amount. The pH of the aqueous solution can vary widely depending on the nature of the rare-earth metal and the water soluble organic chelant. In general, the pH should be adjusted to optimize the solubility of the above components, and is typically in the pH range of from 3 to 12. The appropriate pH range is readily determined by one of ordinary skill in the art by conventional means.

Examples of some particularly advantageous organic chelants which form water-soluble, enhanced corrosion-inhibiting rare-earth metal chelates include catechol-3,5-disulfonic acid (Tiron), citric acid, N,N'-bis(2-hydroxysuccinyl)ethylenediamine (BHS-ED) 3,5-bis((1,1-diphosphonoethyl)-aminomethyl)-4-hydroxybenzensulfonic acid and related compounds as disclosed in U.S. Pat. Application Ser. No. 554,021, filed Jul. 13, 1990 which is hereby incorporated by reference in its entirety, N,N,N',N'-ethylenediaminetetraacetic acid, 1,3-propylene-diamine tetraacetic acid, diethylenetriamine pentaacetic acid, N,N-(diphosphonomethyl)taurine and N-(2-hydroxysuccinyl)glycine.

The water-soluble, organic rare earth metal chelate corrosion inhibitors may also be used in combination with other known water treatment agents customarily employed in aqueous systems including but not limited to other corrosion inhibiting agents such as organophosphonates including 1-hydroxyethylidene-1,1-diphosphonic acid, aminotri(methylenephosphonic acid), 2-phosphonobutane-1,2,4-tricarboxylic acid, 1-phosphono-1-hydroxyacetic acid, hydroxymethylphosphonic acid and the like; phosphates such as sodium phosphate, potassium pyrophosphate and the like; calcium, barium, manganese, magnesium, chromates such as sodium chromate, sodium dichromate, chromic acid and the like; molybdates such as sodium molybdate, molybdenum trioxide, molybdic acid and the like; zinc such as zinc sulfate, zinc chloride and the like, and azoles such as benzotriazole, tolyltriazole, mercaptobenzothiazole and the like, chelants, scale inhibitors, pH regulating agents, dispersants, biocides and the like and mixtures thereof. Examples of suitable chelants are glycolic acid and hydroxymethyl phosphonic acid. Examples of preferred pH regulating agents are acid (e.g., $H_2SO_4$), base (e.g., NaOH), and various buffers (e.g., phosphate or borate). Examples of preferred scale inhibitors are organophosphonates and polyacrylates. Examples of preferred dispersants include carboxylate and sulfonate containing polymers. Examples of preferred biocides include chlorine- and bromine-containing materials and quaternary ammonium salts. The particular weight ratio of the organic-rare earth metal chelates to the foregoing conventional known inhibitors is not per se critical to the invention and can vary from about 100:1 to 1:100 and is preferably from 50:1 to 1:50.

It has also been discovered that certain novel compositions comprising the combination of the foregoing water-soluble, organic, rare earth metal chelates and water-soluble zinc chelates have been found to be surprisingly effective in inhibiting corrosion. Accordingly, a second embodiment of this invention is directed to the combination of one or more of the rare earth chelates of this invention together with one or more water-soluble organic zinc chelates, which combination exhibits surprising and unexpected synergistic corrosion inhibiting properties. The water-soluble organic zinc chelates are prepared in substantially the same manner as the rare earth chelates, i.e., dissolving zinc cations, usually in the form of water-soluble salts, in an aqueous solution containing a suitable water-soluble organic chelant (as hereinafter defined) in at least an equimolar amount to the rare earth metal cation, preferably in a greater then equimolar amount. The pH of the aqueous solution can vary widely depending on the particular zinc salt and water-soluble organic chelant chosen. In general, the pH is from 1 to 12, preferably between 3 and 6.

The weight ratio of rare earth metal chelate to zinc chelate can be from 1000:1 to 1:1000, preferably 100:1 to 1:100 and most preferably in the range of 50:1 to 1:50.

In accordance with this aspect of the invention, there has also been provided a method for inhibiting corrosion of metals which are in contact with aqueous systems having a pH greater than 6 which comprises maintaining in the aqueous system at least one of the subject water soluble rare-earth metal chelates and at least one water-soluble organic zinc chelates in amounts effective to inhibit corrosion of the metal.

The methods of this invention may be used to inhibit the corrosion of ferrous metals as well as certain other non-ferrous metals which include, but are not limited to copper or copper-containing alloys, and aluminum as well as their alloys. The methods of this invention are particularly useful in treating industrial aqueous systems including, but not limited to heat exchangers, boilers, cooling water systems, desalinization equipment, pulp and paper equipment, water-based cutting fluids, hydraulic fluids, antifreeze, drilling mud, and the like, and are particularly useful where the aqueous medium has a moderate to high degree of hardness (mineral content) and alkalinity (carbonate content), is operated at high temperatures (usually greater than 100 F) and/or the aqueous system has high pH (pH of 6 or greater) and may also contain aerated oxygen. The specific dosage amount can vary somewhat depending on the nature of the particular system being treated and is not, per se, critical to the invention provided that the dosage is sufficient to effectively inhibit the formation of corrosion. Those of ordinary skill in the art are intimately familiar with the variables which can affect the dosage amounts of water treatment chemicals in a particular aqueous system and can readily determine the appropriate dosage amount in conventional manners. A preferred dosage amount of the subject corrosion inhibitors will be in the range of 0.1 to 5,000 parts per million ("ppm"), more preferably 0.5 to 1,000 ppm and most preferably 1 to 200 ppm. The treatment compositions employed in this invention can be added to the system water by any conventional means including bypass feeders using briquettes which contain the treatment composition. In addition, since the subject corrosion inhibiting agent or combination of agents can be readily dissolved in aqueous media, it may be advantageous to add these compounds as an aqueous feed solution containing the dissolved treatment components.

The compounds of this invention are relatively non-toxic and can be used for partial or complete substitution of chromate-based corrosion inhibitors, particularly where the toxicity of the chromate-based corrosion inhibitor make its use undesirable. The subject organic rare-earth metal chelates can also be used for partial or complete substitution of phosphate and/or organophosphonate inhibitors to minimize scaling I5 and/or environmental detriments associated with the use of these phosphorus-based inhibitors. Similarly, the organic-rare-earth metal chelates can be used to replace all or part of the zinc-based inhibitors used in some corrosion inhibitor formulations, thus yielding a more environmentally-acceptable formulation and minimizing zinc fouling at high pH. The organic-rare-earth metal chelates of the subject invention provide a more economically viable means of inhibiting corrosion over the use of molybdates.

The following examples are provided to illustrate the invention in accordance with the principles of the invention and are not to be construed as limiting the invention in any way except as indicated in the appended claims. All parts and percentages are by weight unless otherwise indicated.

EXAMPLE 1-8

Test water was prepared to simulate the actual aqueous systems found in cooling tower systems. The water contained 99 parts per million (ppm) $CaSO_4$, 13 ppm $CaCl_2$, 55 ppm $MgSO_4$ and 176 ppm $NaHCO_3$. To separate aliquots of the test water were added the additives listed in Table I. The additives were solubilized in water, and were introduced in the form of a chelant alone, a rare earth cation (in the form of the chloride salt) alone, or a rare-earth metal chelate. The solution was then adjusted to pH=8.5 with NaOH(aq). A clean, preweighed SAE 1010 mild steel coupon was suspended in 0.9 liters of test solution, which was stirred at 54° C. for 24 hours. The mild steel specimen was then cleaned, dried under vacuum at 60° C. and weighed. The corrosion rates, expressed in mils (thousandths of an inch) per year (mpy) were determined from this weight loss and are listed in Table I for each additive.

TABLE 1

| Example | Chelant (30 ppm) | Corrosion Rate Chelant Alone | Corrosion Rate with Chelant Plus 7 ppm Rare-Earth Metal Ions |
|---|---|---|---|
| 1 | None | 60 mpy | 37 mpy (a) |
| 2 | Catechol-4-sulfonic acid | 38 mpy | 5 mpy (b) |
| 3 | Catechol-3,5-disulfonic acid | 39 mpy | 5 mpy (a) |
| 4 | Citric Acid | 43 mpy | 7 mpy (b) |
| 5 | 3,5-bis((1,1-diphosphonoethyl)-aminomethyl)-4-hydroxybenzene sulfonic acid (c) | 20 mpy | 9 mpy (a) |
| 6 | N,N,N'N'-ethylenediamine-tetraacetic acid | 72 mpy | 27 mpy (b) |
| 7 | N,N-(diphosphonomethyl)taurine | 13 mpy | 5 mpy (b) |
| 8 | 3,5-bis[di-N,N-(carboxymethyl) aminomethyl]-4-hydroxybenzenesulfonic acid | 64 mpy | 13 mpy (b) |

(a) Rare earth metal ions consisted of 24% La, 49% Ce, 6% Pr, 21% Nd by weight.
(b) Rare earth metal ions consisted of 100% La.
(c) Chelant concentration was 20 ppm.

EXAMPLE 9-16

Stock solutions of rare-earth metal chelates were prepared by first dissolving 0.1 M of the chelants or their sodium salts in deionized water (pH ~6) and then adding 0.05 M rare-earth metal salt (e.g. chloride salt) to form soluble or insoluble salt/complex mixtures at pH 3-4. The soluble 1:1 complexes were obtained by raising the solution pH to 8.5 with NaOH. Small aliquots of stock solutions were added to 0.9 liters of test water at 30 ppm total (REM-chelant) concentration. The mild steel coupons were first degreased in hexane, and then preweighed before being introduced into the stirred test water solution which had been heated to 55° C for a one-hour period. After the 24 hours corrosion test at 55° C., the specimens were cleaned, dried and weighed to determine the weight losses. The corrosion rates (mpy) calculated for different rare earth chelates are recorded in Table II below.

TABLE II

CORROSION RATES (MPY) OF MILD STEEL COUPONS FOR VARIOUS RARE EARTH CHELATES IN CTW

| | | RARE-EARTH METALS (6 PPM) | | | |
|---|---|---|---|---|---|
| Example | Chelants (24 ppm) | None | La | Nd | Ce |
| 9 | None | 57 | 54 | 71 | 75 |
| 10 | 2-phosphonobutane-1,2-4-tricarboxylic acid | | 12 | | |
| 11 | N,N'-bis(2-hydroxy-succinyl)-ethylene-diamine (BHS-ED) | 47[a] | 3.5[b] | 6.6 | |
| 12 | N,N'-bis(2-hydroxy-succinyl)-1,3-diamino-2-hydroxypropane | | 4.6 | | |
| 13 | N,N',N''-tris(2-hydroxysuccinyl)-tris(2-aminoethyl) amine | | 9.4 | | |
| 14 | Iminodi-(2-hydroxy-succinic acid) | | 9.4 | | |
| 15 | N-(2-hydroxysuccinyl)-glycine | | 3.3 | | |
| 16 | N,N'-bis(2-hydroxy-succinyl)-diethylene triamine | | 5.2 | | |

[a]20 ppm BHS-ED
[b]16 ppm BHS-ED + 4 ppm La

EXAMPLE 17

The following organic chelants did not provide water-soluble organic-rare earth metal chelates when dissolved with rare earth metals in accordance with the procedures of examples 2-8: guaiacol sulfonic acid, 2-hydroxy-phosphonoacetic acid, malic acid, hydroxymethylphosphonic acid. These are shown for comparative purposes only.

EXAMPLE 18

The corrosion inhibiting property of a rare-earth metal (REM) chloride and REM chelates were evaluated in a recirculating rig using test water with a linear flow rate of 3 feet per second. The REM consisted of a mixture of lanthanum 26.59%, cerium 46.88%, praseodymium 5.96%, and neodymium 20.57%. The recirculating rig was pre-passivated by treating the systems with triple the normal dosage of additive and recirculating the water for one day. The concentration of additive was thus reduced to normal dosage ranges for the actual test water. Four mild steel coupons were weighed and suspended for three days in the test water at 110° F. At the end of the test, the steel coupons were removed, cleaned and reweighed, and an average corrosion rate (in mils per year) over the three days was calculated on the basis of coupon weight loss. The results are provided in the table below.

TABLE II

| Run No. | Additive (20 ppm ligand) | Dosage, in ppm REM | pH | Corrosion Rate in MPY |
|---|---|---|---|---|
| 1 | Blank | 0 | 6.5-7.0 | 119.6 |
| 2 | REM chloride | 2 | 6.5-7.0 | 71.6 |
| 3 | REM chelate with di-sodium 4,5-dihydroxy-1,3-benzenedisulfonate (1:10 by weight) | 2 | 6.5-7.0 | 20.6 |
| 4 | REM chelate with catechol-4-sulfonic acid (1:10 by weight) | 2 | 6.5-7.0 | 16.9 |
| 5 | Blank | 0 | 7.5-8.0 | 106.2 |
| 6 | REM chloride | 2 | 7.5-8.0 | 50.0 |
| 7 | REM chelate with di-sodium 4,5-dihydroxy-1,3-benzenedisulfonate (1:10 by weight) | 2 | 7.5-8.0 | 5.2 |
| 8 | REM chelate with tri-sodium salt of N,N-bis-(2-hydroxy-5-sulfobenzyl) glycine (1:10 by weight) (a) | 2 | 7.5-8.0 | 7.1 |
| 9 | REM chelate with catechol-4-sulfonic acid (1:10 by weight) | 2 | 7.5-8.0 | 4.8 |
| 10 | REM chelate with sodium styrene sulfonate-methacrylic acid copolymer (1:10 by weight) | 2 | 7.5-8.0 | 15.3 |
| 11 | REM chelate with copolymer of 2-acylamido-2-methyl-propanesulfonic acid and methacrylic acid (1:10 by weight) | 2 | 7.5-8.0 | 12.6 |
| 12 | Blank | 0 | 8.5-9.0 | 42.9 |
| 13 | REM chloride | 2 | 8.5-9.0 | 32.0 |
| 14 | REM chelate with di-sodium 4,5-dihydroxy-1,3-benzenedisulfonate (1:10 by weight) | 2 | 8.5-9.0 | 3.7 |

(a) This additive comprises a mixture of both monomeric and polymeric materials.
It can be seen from the above table that the organic REM chelates are superior to the REM salts in corrosion inhibitive activity.

EXAMPLE 19

The corrosion inhibiting property of rare-earth metal/zinc chelates were evaluated in a recirculating rig using test water with a linear flow rate of 3 feet per second. The pre-passivation procedure described in Example 18 was repeated. Four mild steel coupons were weighed and suspended for three days in the test water at 110° F. and a pH of 8.0. At the end of the test, the steel coupons were removed, cleaned and reweighed, and an average corrosion rate (in mils per year) over the three days was calculated on the basis of coupon weight loss. The results are provided in the table below. The blank run without treatment gave a steel corrosion rate of 106.2 MPY.

TABLE III

| Chelant | 2 ppm Zn | 1 ppm Zn/ 1 ppm REM | 2 ppm REM |
|---|---|---|---|
| Catechol-4-sulfonic acid, 20 ppm | 5.0 | 4.2 | 4.4 |
| Disodium 4,5-dihydroxy-1,3-benzenedisulfonate, 20 ppm | 4.3 | 2.9 | 5.2 |
| Sodium styrene sulfonate-methacrylic acid copolymer, 20 ppm | 19.5 | 14.2 | 15.3 |
| Copolymer of 2-acrylamido-2-methylpropanesulfonic acid and methacrylic acid, 20 ppm | 12.7 | 11.2 | 12.6 |

REM, expressed as metal ion, was derived from an aqueous rare-earth chloride solution. The rare-earth composition was 26.59% lanthanum, 46.88% cerium, 5.96% praseodymium, and 20.57% neodymium.

The synergistic effect of the mixture of an organic rare-earth chelate and a zinc chelate for inhibiting corrosion is evident.

EXAMPLE 20

The concentration-step potentiostatic (CSP) method using a rotating disc electrode was used to determine the anodic and cathodic corrosion inhibitions of different rare-earth metal/chelant systems in test water (pH 8.5) at 55° C. The method is based on the measurements of the relative changes of the anodic and cathodic current densities, at constant electrode potential near the open-circuit potential (±30mV), as a result of a stepwise change in inhibitor concentration.

An iron disc electrode was mechanically polished with $\alpha$-alumina ($1\mu$) and washed with deionized water prior to introducing it into the three compartment electrochemical cell. Platinum was used as a counter electrode and saturated calomel as a reference electrode.

The potential of the iron electrode was controlled by a potentiostat with respect to the reference electrode.

Anodic and cathodic corrosion inhibitions expressed as a percentage of $\Delta i/i$ is defined as the percent change in current upon the addition of inhibitor, according to the following equation:

$$\frac{\Delta i}{i}(\%) = \frac{i - i_{in}}{i} \cdot 100$$

where i and $i_{in}$ are current densities in the presence or absence of inhibitors, respectively. The values of $\Delta i/i$ for various rare-earth complexes are given in Table III.

TABLE III

ANODIC (A) AND CATHODIC (C) CORROSION INHIBITORS (%), OF IRON FOR VARIOUS REM COMPLEXES (1:2 REM:L) IN CTW

| | RARE-EARTH METAL | | | |
|---|---|---|---|---|
| CHELANT | None | La | Nd | Ce |
| None | | 18(C) 0(A) | | 20(C) 0(A) |
| Tiron | 52[a](C) −20[b](A) | 78(C) 40(A) | 90(C) 20(A) | 63(C) 42(A) |
| N,N'-bis(2-hydroxy-succinyl)-ethyl-enediamine | | 91(C) 30(A) | 80(C) 65(A) | |

(A) 150 ppm Total
(C) 15 ppm Total
[a]20 ppm,
[b]100 ppm

What is claimed:

1. A method of inhibiting corrosion of metal which is in contact with an aqueous system having a pH of at least 6 comprising maintaining in the aqueous system, in an amount effective to inhibit corrosion of the metal, at least one water-soluble, organic-rare earth metal chelate derived from a rare earth metal having an atomic number in the range 57 to 71 and a water-soluble organic chelant.

2. The method of claim 1 wherein the organic chelant contains two or more aromatic hydroxy groups.

3. The method of claim 2 wherein the organic chelant contains one or more carboxylic acid groups.

4. The method of claim 3 wherein the organic chelant also contains one or more amine or amine oxide groups.

5. The method of claim 4 wherein the organic chelant is N,N-bis-(2-hydroxy-5-sulfobenzyl)glycine.

6. The method of claim 4 wherein the organic chelant is a polymer of glycine, formaldehyde and phenolsulfonic acid.

7. The method of claim 2 wherein the organic chelant also contains one or more sulfonic acid group.

8. The method of claim 7 wherein the organic chelant is catechol-3,5-disulfonic acid.

9. The method of claim 7 wherein the organic chelant is catechol-4-sulfonic acid.

10. The method of claim 1 wherein the organic chelant contains at least four donor groups selected from the group consisting of hydroxy, carboxylic acid, phosphonyl, sulfonic acid, amine, and amine oxide with the proviso that at least two of the groups are carboxylic acid, phosphonyl or hydroxy.

11. The method of claim 10 wherein the chelant is a carboxylate-containing polymer.

12. The method of claim 11 wherein the organic chelant contains one or more amine or amine oxide groups.

13. The method of claim 12 wherein the organic chelant has the following formula:

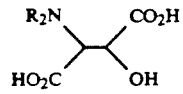

wherein R is independently selected from the group consisting of H, aromatic and alkyl wherein the alkyl group may further contain $CO_2H$, $NR_2$, $SO_3$, $PO_3H_2$ or OH groups.

14. The method of claim 13 wherein the organic chelant is N,N'-bis(2-hydroxysuccinyl)ethylenediamine.

15. The method of claim 12 wherein the organic chelant is selected from the group consisting of N-(2-hydroxysuccinyl)glycine.

16. The method of claim 10 wherein the organic chelant contains one or more carboxylic acid groups and one or more hydroxy groups.

17. The method of claim 16 wherein the organic chelant is citric acid.

18. The method of claim 16 wherein the organic chelant contains one or more sulfonic acid groups.

19. The method of claim 18 wherein the organic chelant is 3,5-bis-(di-N,N-(carboxymethyl)aminomethyl)-4-hydroxybenzenesulfonic acid.

20. The method of claim 10 wherein the organic chelant contains one or more carboxylic acid groups and one or more amine or amine oxide groups.

21. The method of claim 20 wherein the organic chelant is ethylenediamine tetraacetic acid.

22. The method of claim 20 wherein the organic chelant is 1,3-propylenediamine tetraacetic acid.

23. The method of claim 20 wherein the organic chelant is diethylenetriamine pentaacetic acid.

24. The method of claim 10 wherein the organic chelant contains one or more carboxylic acid groups and one or more sulfonic acid groups.

25. The method of claim 24 wherein the organic chelant is a polymer.

26. The method of claim 10 wherein the organic chelant contains one or more phosphonic acid groups.

27. The method of claim 26 wherein the organic chelant is 2-phosphonobutane-1,2,4-tricarboxylic acid.

28. The method of claim 10 wherein the organic chelant contains at least one phosphonic acid group and at least one hydroxy group.

29. The method of claim 28 wherein the organic chelant is 3,5-bis((1,1-diphosphono-ethyl)aminomethyl)-4-hydroxy-benzenesulfonic acid.

30. The method of claim 10 wherein the organic chelant contains at least one phosphonic acid group and at least one amine or amine oxide group.

31. The method of claim 30 wherein the organic chelant further contains at least one hydroxy group.

32. The method of claim 31 wherein the organic chelant is N,N-bis(phosphonomethyl)ethanolamine N-oxide.

33. The method of claim 30 wherein the organic chelant further contains at least one sulfonic acid group.

34. The method of claim 33 wherein the organic chelant is N,N-(diphosphonomethyl)taurine.

35. A method according to claim 1 wherein the effective amount is from 0.10 to 5000 ppm.

36. A method according to claim 1 wherein the effective amount is from 0.5 to 1000 ppm.

37. A method according to claim 1 wherein the effective amount is from 1 to 200 ppm.

38. A method of inhibiting corrosion of a metal which is in contact with an aqueous system comprising maintaining in the aqueous system the combination of at least one water-soluble, organic rare earth metal chelate together with a water-soluble organic zinc chelate in an amount effective to inhibit corrosion of the metal, wherein the rare earth metal chelate is derived from a rare earth metal having an atomic number in the range 57 to 71 and an organic chelant.

39. A method according to claim 38 wherein the weight ratio of rare earth metal chelant to zinc chelate is in the range of 1000:1 to 1:1000.

40. A method according to claim 38 wherein the weight ratio of rare earth metal chelate to zinc chelate is in the range of 100:1 to 1:100.

41. A method according to claim 38 wherein the weight ratio of rare earth metal chelate to zinc chelate is in the range of 50:1 to 1:50.

42. A composition useful for inhibiting corrosion in aqueous systems comprising the combination of at least one water-soluble, organic rare earth metal chelate and a water-soluble organic zinc chelate, wherein the rare earth metal chelate is derived from a rare earth metal having an atomic number in the range 57 to 71.

* * * * *